US006356196B1

(12) United States Patent
Wong et al.

(10) Patent No.: US 6,356,196 B1
(45) Date of Patent: Mar. 12, 2002

(54) VERIFIED RECEIPT, NOTIFICATION, AND THEFT DETERRENCE OF COURIER-DELIVERED PARCELS

(75) Inventors: Jacob Y. Wong, Goleta; Roy L. Anderson, Glendale, both of CA (US)

(73) Assignee: Jaesent Inc., Goleta, CA (US)

( * ) Notice: Subject to any disclaimer, the term of this patent is extended or adjusted under 35 U.S.C. 154(b) by 0 days.

(21) Appl. No.: 09/676,399

(22) Filed: Sep. 29, 2000

(51) Int. Cl.[7] ..... G08B 13/14
(52) U.S. Cl. ..... 340/571; 340/539; 340/572.1
(58) Field of Search ..... 340/426, 527, 340/528, 539, 988, 989, 571, 572.1, 568.1

(56) References Cited

U.S. PATENT DOCUMENTS

| | | | | | |
|---|---|---|---|---|---|
| 5,347,274 | A | * | 9/1994 | Hassett | 340/988 |
| 5,574,429 | A | | 11/1996 | Streeter | |
| 5,661,456 | A | | 8/1997 | Staehle, Jr. | |
| 5,757,271 | A | * | 5/1998 | Andrews | 340/571 |
| 5,805,066 | A | | 9/1998 | Murdy | |
| 5,847,647 | A | | 12/1998 | Devine | |
| 5,907,286 | A | | 5/1999 | Kuma | |
| 5,917,925 | A | * | 6/1999 | Moore | 382/101 |
| 5,963,131 | A | | 10/1999 | D'Angelo et al. | |
| 6,133,830 | A | * | 10/2000 | D'Angelo et al. | 340/571 |

* cited by examiner

*Primary Examiner*—Van Trieu
(74) *Attorney, Agent, or Firm*—Daniel C. McKown; James F. Cottone

(57) ABSTRACT

The System includes an Alarm Unit and a separate Alert Unit. The Alarm Unit is securely affixed to the parcel before the parcel is left at the delivery site, and the Alert Unit is placed at a secure site that is within radio range of the delivery site. The Alarm Unit is armed by the deliveryman upon depositing the parcel at the delivery site, and arming of the Alarm Unit results in the transmission of messages verifying to the seller or delivery agent that delivery has taken place and notifying the purchaser or intended recipient that the parcel has arrived. Movement of the parcel after it has been deposited at the delivery site and has been armed results in messages being transmitted to the shipping agent and to the intended recipient announcing that the parcel has been stolen. Such unauthorized movement of the parcel also activates a very loud audible alarm affixed to the parcel and activates a tracking beacon in or on the parcel, permitting the whereabouts of the parcel to be determined or tracked. The intended recipient of the parcel, after being notified of its delivery can disarm the Alarm Unit by inserting a secret number into a keypad on the Alarm Unit and then pressing a disarm button. Upon being disarmed, the Alarm Unit generates a signal that causes the Alert Unit to notify the seller and the delivery agent that an authorized person has taken possession of the parcel, thereby verifying receipt.

10 Claims, 3 Drawing Sheets

VERIFIED RECEIPT, NOTIFICATION, AND THEFT DETERRENCE OF COURIER-DELIVERED PARCELS

BACKGROUND OF THE INVENTION

1. Field of the Invention

The present invention is in the field of system and methodology for the delivering of goods and more specifically relates to the notification, verification, tracking and safeguarding of parcels delivered by a courier.

2. The Problem to be Solved

Everyday many millions of parcels, large and small, are delivered to households and companies all around the world by delivery companies such as United Parcel Service (UPS), Federal Express, Airborne, DHL, etc., to name a few. More and more people today purchase goods from distant sources instead of buying them on site in local shopping malls or at local retail stores.

Typically a consumer orders goods from a source via telephone or mail (commonly referred to in the business as "MOTO" or Mail Order Telephone Order) and selects a delivery service, viz. regular ground, airmail or next-day speed delivery, etc. As proof of a successful transaction, the consumer receives a confirmation number and thereafter expects the ordered goods to be delivered to his residence.

Depending on prior arrangements, the delivery agent might have instructions to not deliver the parcel containing the ordered goods unless there is somebody present to receive it. Additionally, the delivery agent might demand someone's signature in exchange for the parcel in order to provide evidence of the delivery and receipt of the goods. Normally this is not a problem for deliveries made at a business as there is normally someone there to receive and sign for the goods.

However, deliveries to residences have always been a nagging problem to both the consumer and the delivery agent when the consumer is not at home to receive the ordered goods. This situation is a common occurrence as both members of a married couple may work during the day, and delivery agents seldom make deliveries after regular working hours. For consumers, this situation is highly inconvenient and incompatible with their lifestyle as more often than not they have to take delivery at the shipping agent's location, if they need the goods in a hurry. For delivery agents, the repeated delivery of the same ordered goods to the consumers' residences or the additional handling and storing of the undelivered goods needed in order to complete a delivery contract means extra expense without any added business advantage other than maintaining the company's good will and service reputation to the public. Mundane as it is, this problem has persisted for decades to the present time in this industry seemingly still without any physically and economically workable solution.

The advent of the Internet in recent years creates a new dimension of merchandise choice and convenience for consumers. This new mode of shopping further aggravates the decades old problem of home delivery of ordered goods. First, the goods ordered on the Internet still have to be delivered to the customers'residences. Consequently, the manner of conducting business has not changed. Second, in addition to MOTO, we now have the added volume of Internet orders to contend with, further exacerbating the frustration levels of both the consumers and delivery agents. Fortunately the potentially huge financial reward in coming up with an economically viable solution to this problem has finally caught the attention of a number of resourceful individuals. As a result, proposed solutions to remedy this problem have finally started to emerge as recently as only several years ago.

THE PRIOR ART

Prior to the recent proposed solutions to this particular package delivery problem, a number of item detection alarm methodologies aimed generally at the prevention of thefts via alarm or information transmittal for a variety of devices and objects, large and small, had been advanced.

In U.S. Pat. No. 5,574,429 issued to Streeter on Nov. 12, 1996, a self-contained programmable alarm system securely attached to an article is described. The article is protected by activating an alarm device when the article is moved. Non-position-sensitive, vibration activated switching means are included for activating the alarm device after sensing movement of the article. Although this alarm system can protect against the theft of an article, its implementation is rather complex and expensive to use for solving the current package delivery problem where simplicity and low cost are mandatory in order that such a system can be deployed and accepted by the general public.

In U.S. Pat. No. 5,661,456 issued to Staehle, Jr. on Aug. 26, 1997, a theft preventive purse comprising an opening with a keypad situated adjacent thereto with the keypad adapted to transmit an access signal for a predetermined amount of time upon entry of a proper code is disclosed. This invention is aimed specifically towards an improved anti-theft purse with the added feature of a panic button in addition to the conventional audible alarm when unauthorized access to the purse is encountered.

In U.S. Pat. No. 5,805,066 issued to Murdy on Sep. 8, 1998, an instrument case and alarm is disclosed which provides a reliable alarm system that selectively uses audio, visual and radio alerts to attract attention to the case and instrument. The system advanced is meant for a very special application such as an expensive musical instrument in a carrying case and therefore not suitable, both from simplicity and cost standpoints, for the currently encountered general package delivery problem.

In U.S. Pat. No. 5,907,286 issued to Kuma on May 25, 1999, there is described a transport container and managing system suitable for use when valuable goods are transported by a transportation service. Such a system is specifically advanced for delivery services used by banking facilities when valuable goods such as money, jewelry or security articles are transported.

In U.S. Pat. No. 5,963,131 issued to D'Angelo et al. on Oct. 5, 1999, there is described a motion sensitive theft detector system for portable articles featuring two way communication between the theft detector unit installed in or affixed to the portable article and the control unit carried by the owner. One of the special features of this invention is the adaptive alarm sequence which allows the alarm to vary in response to frequency and duration of motion so that isolated movement triggers a warning but persistent motion triggers a full scale alarm. It is apparent that the complexity and sophistication of such a theft alarm works best for special situations but not so when a simple, low cost package delivery alarm system is called for.

In U.S. Pat. No. 5,847,647 issued to Devine on Dec. 8, 1998, there is described an alarm for detecting the unauthorized movement of an object. The system includes a motion detector, programmable microprocessor and an audible alarm all contained within a housing. The specific objective of this disclosure is to provide a simple and effective motion detection means and to provide an alarm device that can be attached to valuable items, and that will sound an alarm if the item is moved.

Thus there is still today an urgent need, especially in view of the exponentially increasing Internet online shopping volume, for a novel solution to the home package delivery problem. Internet shopping online and the traditional MOTO shopping no doubt offer consumers with appealing conveniences, however, until such time that the home packages delivery problem is solved, the potential of these modes of shopping cannot be fully realized.

SUMMARY OF THE INVENTION

It is an object of the present invention to provide a viable yet economical solution to the home package delivery problem. The present invention provides adequate protection for the delivered package, notification and verification of the delivery to both the addressee and the shipper, and permits tracking of the delivered package in the event that it is illegally removed from the delivery site.

The package delivery system of the present invention, hereafter referred to as the Delivery Alert System or DAS for simplicity, includes an Alarm Unit, an Alert Unit and an optional Tracking Beacon. The Alarm Unit is securely attached to the parcel and cannot be easily removed from the parcel without literally destroying a significant portion of the parcel itself Thus, the Alarm Unit is left with the parcel at the delivery site and remains with the parcel.

The Alarm Unit contains an alarm circuit which works in conjunction with a multiple-digit keypad so that it can be armed or disarmed by entering the correct multiple-digit code into the keypad. The Alarm Unit also contains a motion detector which will trigger the onset of a very loud audible alarm when the parcel is moved while armed.

The Alarm Unit also contains a short-range wireless transmitter which sends a DELIVERY CONFIRMATION signal to the Alert Unit (see below) when the parcel is armed at the delivery site. When the Alarm Unit sounds the audible alarm indicating that the parcel is being moved illegally (i.e., the alarm is not properly disarmed), the Alarm Unit simultaneously sends a VIOLATION signal to both the Alert Unit and the Tracking Beacon. When the Alarm Unit has been disarmed, the transmitter sends a RECEIVED signal to the Alert Unit. Finally a power supply means, such as a lithium ion sheet battery, is included in the Alarm Unit in order to power all its operations.

The Alert Unit is typically located inside the intended recipient's home. It receives the DELIVERY CONFIRMATION signal from the Alarm Unit when the Alarm Unit is armed at the time of delivery. After the receipt of this signal, the Alert Unit sends a signal (predetermined by the addressee to be by phone or e-mail or both) to the parcel's intended recipient. It also sends a signal to the designated local agent of the delivery company or agent notifying him that the parcel has been successfully delivered.

Upon receiving the VIOLATION signal from the Alarm Unit, the Alert Unit notifies the delivery agent and the local police that the parcel has been stolen.

Upon receiving the RECEIVED signal from the Alarm Unit, the Alert Unit notifies the delivery agent and the shipper (or seller) of the goods that the intended recipient has taken possession of the goods.

The Tracking Beacon is a small device which optionally may be included in any parcel. When the parcel is illegally removed from the addressee's premise after its delivery, the Tracking Beacon receives the VIOLATION signal from the Alarm Unit to commence broadcasting. The local police or other security personnel may use one or more receivers equipped with directional antennas to track or home in on the stolen package, using the signals broadcast by the Tracking Beacon.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
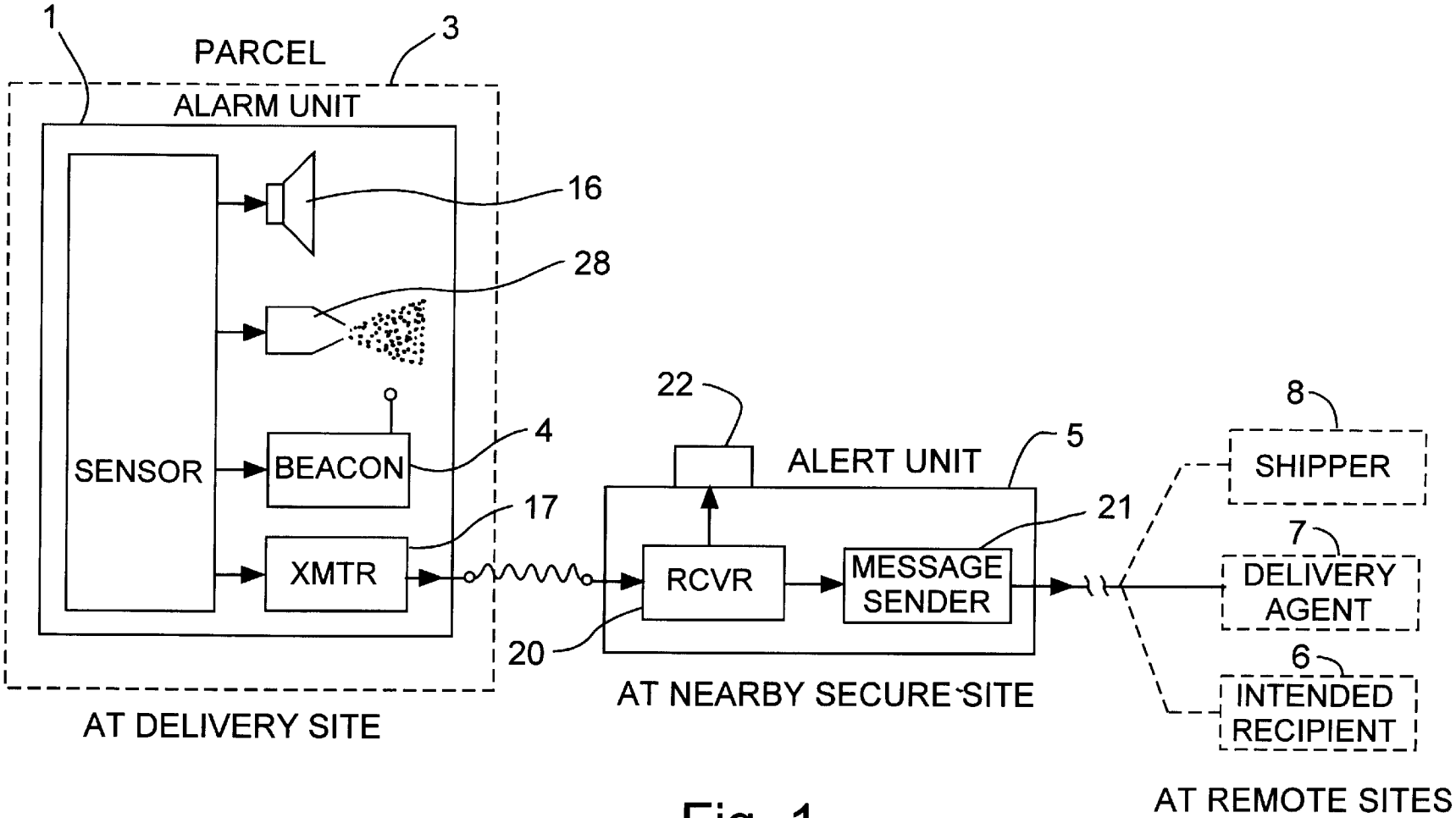
FIG. 1 is a functional diagram illustrating the major components of the Delivery Alert-System of the present invention.

FIG. 1 is a functional diagram showing a preferred embodiment of the entire Delivery Alert System. FIG. 1 gives a broad overview of the System, and the major units of the System are shown in greater detail in the other drawings. The major units of the System are the Alarm Unit 1 and the Alert Unit 5. The Alarm Unit 1 is affixed to the parcel 3 by a very strong adhesive, and the Alarm Unit remains with the parcel when the parcel has been left at the delivery site. The parcel 3 is not part of the present invention.

In the preferred embodiment, the Alarm Unit includes a tracking beacon 4, which emits a characteristic radio signal when activated.

Because the Alarm Unit is so strongly affixed to the parcel 3, which usually is not reused, the Alarm Unit includes only essential components and is implemented as inexpensively as possible since it is considered to be disposable.

Other components of the System are contained in the Alert Unit 5 which is located at a secure site within radio range of the transmitter 17. The transmitter 17 selectively sends three types of signal: a DELIVERY CONFIRMATION signal that is generated when the Alarm Unit is armed at the time it is left at the delivery site, a VIOLATION signal that is generated when the motion sensor 15 detects subsequent unauthorized movement of the parcel, and a RECEIVED signal that is generated when the Alarm Unit is disarmed.

When any of these three signals is received by the receiver 20, the Alert Unit 5 sends messages to preset remote locations announcing that the parcel has been delivered, that the delivered parcel has been stolen, or that the delivered parcel has been received. These messages may be sent by any suitable communications mode, such as by telephone, by fax, by e-mail, by cellular telephone, or by radio, or by any combination of these modes. In addition, the Alert Unit 5 includes a display 22 that conveys the same information visually to anyone who may be present. In normal use, the messages would be sent to the addressee of the parcel or to an agent of the addressee and would also be sent to the delivery company. However, it is also feasible to send a message to the local police or to a private security company informing them that the parcel has been stolen.

The System is capable of sending these messages regardless of whether the tracking beacon 4 is included in or on the parcel 3. The tracking beacon 4 is helpful in permitting the police to locate a stolen parcel and (along with the audible alarm) in providing additional protection against a dishonest addressee who contrives to make it appear that a parcel has been stolen when, in fact, he has received it. It can be appreciated that the theft of parcels will be discouraged if thieves believe that the parcels contain or might contain a tracking beacon.

Figure 2:
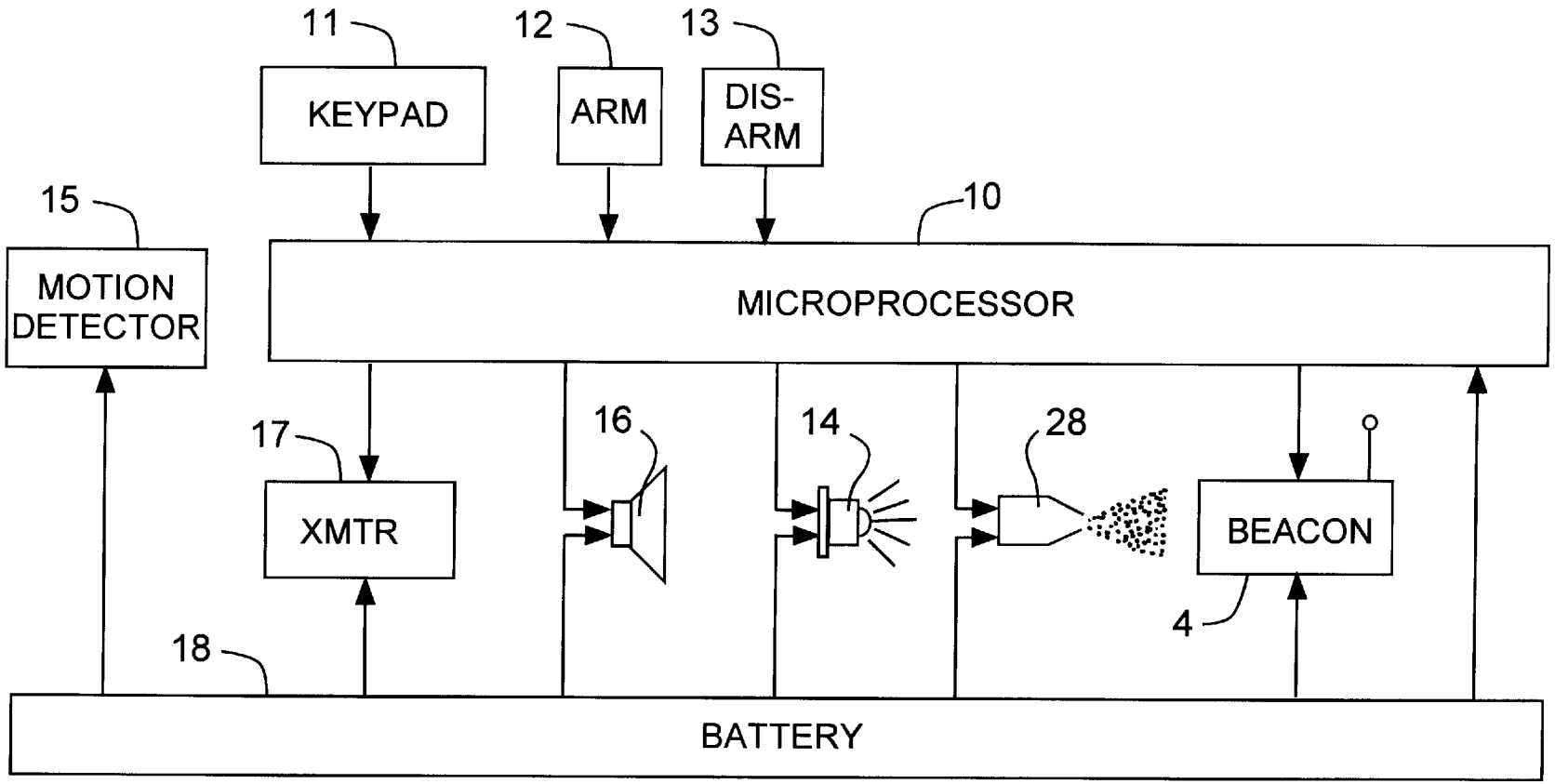
FIG. 2 is a diagram of the Alarm Unit in a preferred embodiment.

FIG. 2 shows the Alarm Unit 1 in greater detail. In the preferred embodiment, the sensor shown in FIG. 1 includes a motion detector 15 and a microprocessor 10. A keypad 11 is used for entering any combination of identifying numbers or letters into the microprocessor 10. The identifier entered in the keypad 11 is stored in the microprocessor 10 by pushing the ARM button 12, thereby arming the Alarm Unit. The Alarm Unit may be disarmed by entering the same identifier in the keypad 11 and pushing the DISARM button 13. A logic circuit associated with the microprocessor prevents disarmament from occurring unless the second identifier entered matches the one that was entered when the Alarm Unit was armed. It is not sufficient merely to press the DISARM button; disarmament occurs only if the user enters the correct identifier. The microprocessor 10 ignores the output of the motion detector 15 except during the time interval in which the Alarm Unit is armed. The microprocessor 10 also includes circuitry that ignores the output of the motion detector 15 even when the Alarm Unit is armed unless the output of the motion detector persists for a brief preset duration. This reduces the frequency of false alarms caused by accidental movements made in the course of disarming the Unit.

In the preferred embodiment, the Alarm Unit, upon being successfully disarmed, generates and transmits by the transmitter 17, a RECEIVED signal, signifying that the intended recipient has taken possession of the parcel. The RECEIVED signal is received by the receiver 20 of the Alert Unit and applied to the message sender 21 which notifies the shipper or seller of the goods and the delivery agent that the transaction has been completed.

If the Alarm Unit is armed, and if the motion persists sufficiently or if a specified number of invalid attempts have been made to provide the Alarm Unit with a disarm code, the microprocessor enables the transmitter 17 to transmit a VIOLATION signal and activates loudspeaker 16 that produces a very loud audible alarm. These signals persist until the Alarm Unit is disarmed or until the battery 18 is exhausted. In the preferred embodiment, the microprocessor also activated a dye dispenser when the VIOLATION signal is produced. The dye dispenser is located in or on the Alarm Unit, and when activated, it expels a brightly colored dye, which may also be photoluminescent, onto the thief to assist in identifying the thief.

It will be recognized that the use of the keypad 11, ARM button 12, DISARM button 13, and microprocessor 10 as described above constitutes the electrical equivalent of a mechanical combination lock. Although an electrical lock is preferred, it may be implemented in several ways, all of which are encompassed by the present invention. For example, the ARM button and DISARM button do not have to be pushbuttons, but instead, in other embodiments may be levers, knobs, or slidable elements that actuate electrical switches. Also, in other embodiments the keypad is replaced by an array of frangible conductors which are selectively broken to enter the identifier in a tamper-resistant manner.

Confirmation delivery is achieved in the following way. When the Alarm Unit is armed by pressing the ARM button 12, the microprocessor 10 orders the transmitter 17 to produce a DELIVERY CONFIRMATION signal that persists for a limited time. Note that it is the pressing of the ARM button 12 and not the entry of an identifier into the keypad 11 that produces the DELIVERY CONFIRMATION signal. So long as the System is armed, the microprocessor 10 causes the indicator light 14, located near the keypad 11 and visible to the user, to flash repeatedly to give visual confirmation that the Alarm Unit is armed. Also, when the microprocessor 10 has determined that unauthorized movement of the parcel has taken place, the microprocessor causes the indicator light 14 to operate continuously. Power for the motion detector, the transmitter 17, the loudspeaker 16, the indicator light 14, and the microprocessor 10 is supplied by the battery 18. In the preferred embodiment, the battery 18 is of a type known as a lithium ion sheet battery.

Figure 3:
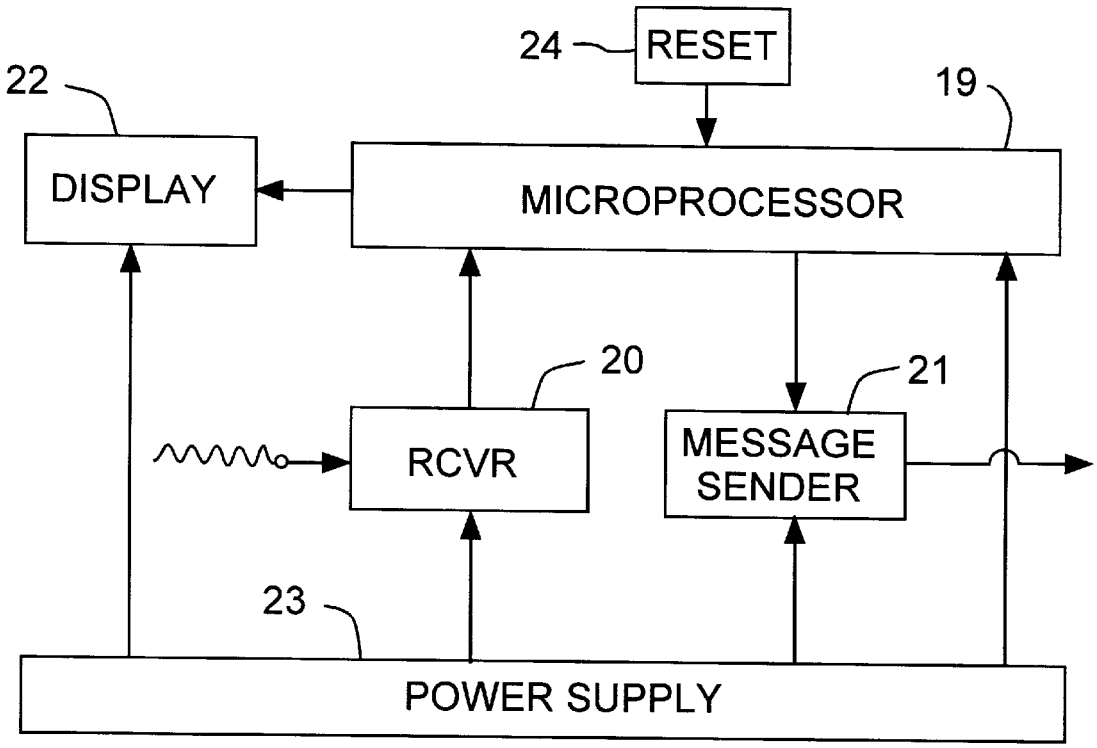
FIG. 3 is a diagram of the Alert Unit in a preferred embodiment.

FIG. 3 shows the Alert Unit in greater detail. Upon receiving a radio signal from the transmitter 17 of FIG. 2, the receiver 20 of the Alert Unit of FIG. 3 determines whether the signal is a DELIVERY CONFIRMATION signal, a VIOLATION signal, or a RECEIVED signal, and informs the microprocessor 19 of the presence and nature of the radio signal. If the radio signal is a DELIVERY CONFIRMATION signal, the microprocessor applies a signal to the message sender 21 causing the message sender to send a DELIVERY CONFIRMATION message to one or more addresses stored in the message sender 21. These messages are sent in succession and may identify the parcel and give the date and time of delivery. The message can be sent by the message sender 21 by Wireless Application Protocol (WAP) telephony, via a regular telephone line, or by e-mail through the Internet. The microprocessor also displays on the display 22 the receipt acknowledgment and the date and time of arrival of the delivered parcel.

In the event the receiver 20 has received a VIOLATION signal from the transmitter 17, the microprocessor sends a signal to the message sender 21 causing the message sender to send a violation message to a stored list of destinations, and the order and content of this list may differ from that of the list used in confirming delivery. Also, the microprocessor applies a signal to the display 22 causing it to operate continuously or otherwise produce a visual indication that the parcel has been stolen. Power for the display, the receiver 20, the message sender 21, and the microprocessor 19 is supplied by the power supply 23, which may operate from batteries or from line current.

After a parcel has been properly disarmed by the addressee, the Alert Unit 5 can be reset using the RESET button 24. Disarming of the Alarm Unit causes the transmitter 17 to transmit a RECEIVED signal. Upon receiving this signal, the receiver 20 informs the microprocessor 19 that a RECEIVED signal has been received. In response, the microprocessor 19 directs the message sender 21 to send messages to the delivery agent and to the shipper (or seller) of the goods acknowledging that an authorized recipient has taken possession of the parcel and its goods.

Figure 4:
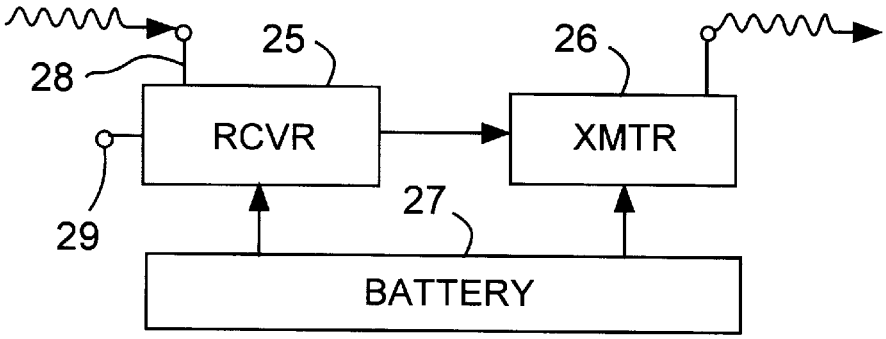
FIG. 4 is a diagram of the Tracker Unit in a preferred embodiment.

FIG. 4 shows the beacon 4 of FIG. 1 in greater detail. The tracking beacon includes a receiver 25, a transmitter 26 and a battery 27. The tracking beacon is designed to be compact and inexpensive, and is considered to be disposable. In the preferred embodiment, when the microprocessor 10 of FIG. 2 determines that the parcel has been stolen, the microprocessor 10 orders the transmitter 17 to emit a VIOLATION radio signal, which differs from the DELIVERY CONFIRMATION signal. The antenna 30 of the receiver 25 intercepts the VIOLATION radio signal. When the receiver 25 determines that a VIOLATION signal has been received, the receiver 25 applies a signal to the transmitter 26, turning it on. The transmitter 26 thereafter continuously broadcasts a radio signal usable for tracking the parcel.

In operation, the Delivery Alert System functions and is used as follows. The purchasing customer or addressee obtains a valid disarm code (D-Code), referred to above as an identifier, from the merchant from whom the customer orders goods. The D-code is typically a multi-digit number assigned by the merchant, and associated with a particular purchase order for goods which are to be delivered to the customer.

For purchases in which the customer is face-to-face with the merchant, the D-code is written or printed on the customer's receipt.

For Mail Order and Telephone Order (MOTO), the customer receives the D-code either directly on the phone during the ordering process or later through a subsequent telephone, mail or e-mail notice. For Internet purchases, the customer will also receive the D-code associated with a particular order via e-mail.

Alternatively, a customer can arrange with one or more delivery agents such as UPS, FedEX, etc., to have a unique and confidential D-code assigned to him or her. Preferably, only one D-code per customer will work with all common delivery agents. It is also possible for the U.S. Postal Service to use the System of the present invention. In this case a person residing at a particular postal address can obtain his or her own unique and confidential D-code from the Postal Service for use with all U.S. Parcel Post deliveries.

The customer must also obtain an Alert Unit 5 of FIG. 1. It is the customer's responsibility to install the Alert Unit 5 within his residence and to make sure it remains operational when delivery of a parcel is expected.

In the preferred embodiment of the method of using the System, the seller of the goods wraps them for shipment, and may chose to enclose the tracking beacon of FIG. 4 within the parcel. The seller of the goods then hands the parcel over to the delivery agent along with the D-code associated with the parcel. The delivery agent then delivers the goods to the delivery site, affixes the Alarm Unit to the parcel, enters the D-code into the Alarm Unit through the keyboard 11 and arms the Alarm Unit by use of the ARM button 12 of FIG. 2.

Because of its ability to verify delivery to the designated address and receipt of the goods by an authorized recipient, the system and method of the present invention permits improvements in the process of billing for the goods and for their delivery.

For example, the seller of the goods could be billed by the delivery agent for delivery charges after a DELIVERY CONFIRMATION signal is received from the message sender 21. The amount of the charges could be based on whether the parcel was delivered by a promised time; this would allow the seller to confirm that he is properly paying for expedited delivery and to make an adjustment to the charges if such expedited delivery was not, in fact, accomplished.

In a similar manner, the intended recipient could be billed for the goods after the RECEIVED message has been received by the seller of the goods, verifying actual physical receipt of the parcel by the intended recipient.

An alternative embodiment of the method may be used when it is considered undesirable for the delivery agent to have access to the D-code. In this alternative embodiment, the seller of the goods wraps the goods for shipment and may include the tracking beacon of FIG. 4 within the parcel. Thereafter, the seller of the goods affixes the Alarm Unit to the parcel and uses the keypad 11 to enter the D-code into the Alarm Unit. However, the seller of the goods does not arm the Alarm Unit. The seller of the goods then hands the parcel over to the delivery agent who delivers it to the delivery site, where the delivery agent performs the arming operation by use of the ARM button 12. In this embodiment, the D-code is known only to the seller and the purchaser.

Hopefully, the delivery process is completed in the normal manner wherein the addressee enters the D-code into the keypad 11 and then disarms the Alarm Unit by pressing the RESET button 13. Once disarmed, the parcel may be moved without fear of setting off an alarm.

However, if the parcel is moved appreciably after it has been delivered and armed, the movement will be detected by the motion detector 15, which will set off the system of alarms described above in connection with FIG. 2, including a very loud audible alarm, activation of the tracking beacon 4 and dye dispenser 28, and transmission of messages to the intended recipient, the delivery agent, and possibly the police, announcing that the parcel has been stolen.

As described above, arming of the Alarm Unit results in a message being sent to the delivery agent verifying that delivery has been made and also results in a message being sent to the intended recipient notifying him that the parcel has been delivered, and also produces a display at the Alert Unit which also serves to notify the intended recipient that the parcel has been delivered.

In an alternative embodiment, Alert Unit 5 can send or store messages in a file that can be queried by the addressee or the shipper. Thus, rather than sending a DELIVERY CONFIRMATION signal or a RECEIVED signal to the delivery agent or the sender, either entity can periodically submit a query for any such signals. In this alternative embodiment, the file of messages functions as a log, and this log can be queried on a periodic basis for billing purposes, or if a particular delivery is called into question. It can also be queried by the addressee in the same manner that a person with an e-mail account can periodically check for mail, so that the addressee can check for home deliveries. If the file is linked with information provided by the shipper or the delivery agent, the addressee can also determine the nature of the contents of the parcel that has been delivered to the addressee. This could be particularly useful if an addressee is expecting delivery of multiple items, and is particularly concerned about delivery of a particular item, or grouping of items.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A high security method of delivering a parcel from a shipper to a recipient via a deliverer using a system that includes an alarm unit affixed to a parcel to be delivered, which alarm unit is operable in concert with an alert unit prepositioned at a recipient's delivery site, wherein the alarm unit and alert unit are responsive to a preestablished identification code, said method comprising the steps of:

(a) providing a shipper-supplied alarm unit having at least one alarm device, a motion detector for detecting movement of the alarm unit, a wireless transmitter for sending one or more classes of messages taken from the group including a delivery confirmation message, a receipt message and a violation message, a data input device for receiving an arming input including said preestablished identification code and for receiving a disarm input also including said preestablished identification code, all connected to a first logic processor and a self-contained power source;

(b) providing a recipient-controlled alert unit having a wireless receiver, a message sender, a display means, all interconnected with a second logic processor and a power source;

(c) providing a preestablished identification code via an independent communications means to said deliverer and to said recipient;

(d) affixing said alarm unit to a parcel to be delivered before the parcel is left at the delivery site;

(e) placing said alert unit by said recipient at the delivery site within range of the wireless transmitter;

(f) arming said alarm unit by said deliverer by entry of said preestablished identification code via said data input device upon delivery of said parcel at said delivery site;

(g) whereupon said transmitter sends a delivery confirmation message to said alert unit for further dissemination by said message sender, the type of said further dissemination selected by said second logic circuit from the group including displaying said message on said alert unit, notifying said recipient on said alert unit, initiating an alarm from said at least one alarm device on said alarm unit, and notifying one or more third parties at preset remote locations using disparate messaging channels;

(h) and whereupon said motion detector is enabled to initiate a transmitter sent violation message to said alert unit for further dissemination as before should alarm unit movement detection occur before disarming of said alarm unit by the recipient; and (i) disarming said alarm unit by said recipient by entry of said preestablished identification code via said data input device whereupon said transmitter sends a received message to said alert unit for further dissemination as before.

2. The method of claim 1 wherein said preestablished identification code is established by said shipper/merchant.

3. The method of claim 1 wherein said disparate messaging channels are selected from the group including telephone, fax, e-mail, cell phone, WAP telephony, radio and Internet.

4. The method of claim 1 wherein said at least one alarm device is one or more devices selected from the group including an audible alarm, a visual alarm, a dye dispensing means and a radio tracking beacon.

5. The method of claim 1 wherein said preset remote locations are selected from the group including the shipping company, the delivery company, the police and at least one security company.

6. A system for high security delivery of a parcel from a shipper/merchant to a recipient/addressee via a deliverer, said system of the type employing an alarm unit affixed to the parcel to be delivered and an alert unit operable in concert with the alarm unit, said alert unit prepositioned at a recipient's delivery site, and said alarm unit and said alert unit being responsive to a preestablished identification code, said system comprising:

(a) a shipper-supplied alarm unit having at least one alarm device, a motion detector for detecting movement of the alarm unit, a wireless transmitter for sending one or more classes of messages taken from the group including a delivery confirmation message, a receipt message and a violation message, a data input device for receiving an arming input including said preestablished identification code and a disarm input which also includes said preestablished identification code, all operatively connected to a first logic processor and a self-contained power source;

(b) a recipient-controlled alert unit having a wireless receiver, a message sender, a display means, all operatively connected to a second logic processor and a power source;

(c) a preestablished identification code provided via an independent communications means to said deliverer and said recipient;

(d) whereby upon affixing said alarm unit to a parcel to be delivered before the parcel is left at the delivery site, and placing said alert unit by said recipient at the delivery site within range of the wireless transmitter, and arming said alarm unit by said deliverer by entry of said preestablished identification code via said data input device upon delivery of said parcel at said delivery site;

(e) said transmitter under control of said first logic processor sends a delivery confirmation message to said alert unit for further dissemination by said message sender, the type of said further dissemination selected by said second logic processor from the group including displaying said message on said alert unit, notifying said recipient on said alert unit, initiating an alarm from said at least one alarm device on said alarm unit, and notifying one or more third parties at preset remote locations using disparate messaging channels;

(f) said motion detector under the control of said first logic processor is enabled to initiate a transmitter sent violation message to said alert unit for further dissemination as before should said alarm unit movement detection occur before the recipient disarming of said alarm unit; and (g) whereby upon disarming said alarm unit by said recipient by entry of said preestablished identification code via said data input device, said transmitter sends a received message to said alert unit for further dissemination as before.

7. The system of claim 6 wherein said preestablished identification code is established by said shipper/merchant.

8. The system of claim 6 wherein said disparate messaging channels are selected from the group including telephone, fax, e-mail, cell phone, WAP telephony, radio and Internet.

9. The system of claim 6 wherein said at least one alarm device is one or more devices selected from the group including an audible alarm, a visual alarm, a dye dispensing means and a radio tracking beacon.

10. The method of claim 6 wherein said preset remote locations are selected from the group including the shipping company, the delivery company, the police and at least one security company.

* * * * *